United States Patent [19]

Sheeran, Jr.

[11] Patent Number: 4,484,907

[45] Date of Patent: Nov. 27, 1984

[54] MICROTUBE ADAPTER HAVING A HOLDING AND UNCAPPING APPARATUS

[75] Inventor: Edward T. Sheeran, Jr., Southbury, Conn.

[73] Assignee: E. I. Du Pont de Nemours and Company, Wilmington, Del.

[21] Appl. No.: 543,755

[22] Filed: Oct. 20, 1983

[51] Int. Cl.[3] ..... B04B 15/00

[52] U.S. Cl. ..... 994/85; 211/74; 220/260; 220/262; 220/281; 220/284; 494/16

[58] Field of Search ..... 494/85, 16, 17, 19, 494/20, 21, 37, 67, 76; 211/74; 422/72; 220/260, 262, 281, 284, 255

[56] References Cited

U.S. PATENT DOCUMENTS

| | | | |
|---|---|---|---|
| 3,050,239 | 8/1962 | Williams | 494/16 |
| 3,993,452 | 11/1976 | Moulding | 211/74 |
| 4,284,603 | 8/1981 | Korom | 211/74 |
| 4,375,272 | 3/1983 | Sutton | 494/16 |

*Primary Examiner*—Robert W. Jenkins

[57] ABSTRACT

An adapter for a swinging bucket centrifuge rotor includes a slide plate having a retaining lip and a cam surface thereon. Movement of the plate in one direction to a holding position disposes the lip to hold above the rim of a microtube to hold the same in place. Movement in an opposite direction introduces a cam surface between the rim of the tube and a flange on a closure to thereby uncap the same.

7 Claims, 9 Drawing Figures

MICROTUBE ADAPTER HAVING A HOLDING AND UNCAPPING APPARATUS

BACKGROUND OF THE INVENTION

1. Field of the Invention

The present invention relates to a microtube adapter and, in particular, to an adapter for a centrifuge bucket moveable from a home position to one of two other positions, one other position holding the microtube with respect to the adapter and the second other position uncapping the tube.

2. Description of the Prior Art

It is often desirable to use small, rimmed and capped vials known as microtubes while exposing a sample carried in the microtube to the effects of a centrifugal force field. It is common practice to mount the microtubes in a suitable adapter which is itself received by a centrifuge rotor. Either a peripherally slotted rotor or a swinging bucket rotor may be used to generate the necessary centrifugal force field.

For example, an adapter as shown in U.S. Pat. No. 3,050,239, (Williams) may be utilized to carry microtubes while they are centrifuged in a peripherally slotted rotor. The adapter shown in the Williams patent is a substantially planar member having an array of apertures therein. A microtube is insertable into each aperture while the adapters are themselves slidably receivable within circumferentially disposed slots positioned about the periphery of the rotor.

Microtubes may also be centrifuged while carried by the buckets of a swinging bucket-type centrifuge rotor. In such a rotor each bucket is pivotally mounted between trunion pins carried on angularly adjacent arms emanating from the rotor hub. Typical of such microtube adapters for swing bucket rotors are those sold by E. I. du Pont de Nemours and Company. Inc. under the trademark "Sorvall".

It has been observed, however, that when using adapters for swinging bucket rotors it is difficult to maintain the microtubes in the bucket, especially, for example, when subjecting the microtubes to a water bath. Also, it is cumbersome and time consuming to individually uncap each of the microtubes in an array of such tubes.

Accordingly, it is believed desirable to provide an adapter for the bucket of the swinging bucket centrifuge rotor which will facilitate not only the holding of the microtubes in the adapter but also the uncapping thereof at the completion of the centrifuge run.

SUMMARY OF THE INVENTION

The present invention relates to an adapter particularly useful for a bucket for a swinging bucket centrifuge rotor. The adapter comprises a support plate having an array of openings each sized to receive therein and support a microtube from the underside of the rim thereof. A slide plate having a corresponding plurality of apertures therein is slidably disposed with respect to the support plate. The slide plate has a retaining lip or holding surface disposed along a first portion of the boundary of each aperture and an inclined cam surface disposed upon an opposite portion of the boundary of each aperture. The slide plate is displaceable with respect to the support plate from a neutral, or home, position in a first direction to a first, or holding, position. Movement of the slide plate in the first direction moves the plate to a holding position in which the holding surface is disposed over a portion of the rim of a microtube supported by the support plate. The slide plate is displaceable in a second, opposite, direction from the home position to a second, or uncapping, position. As the slide plate moves to the second position the cam surface is progressively inserted into the clearance space between the rim and the tube cap to thereby urge the cap from the tube.

BRIEF DESCRIPTION OF THE DRAWINGS

The invention may be more fully understood from the following detailed description thereof taken in connection with the accompanying drawings which form a part of this application and in which:

FIG. 1 is a plan view of a microtube adapter in accordance with the present invention with the slide plate disposed in the neutral, or home, position; while

DETAILED DESCRIPTION OF THE INVENTION

Figure 1:
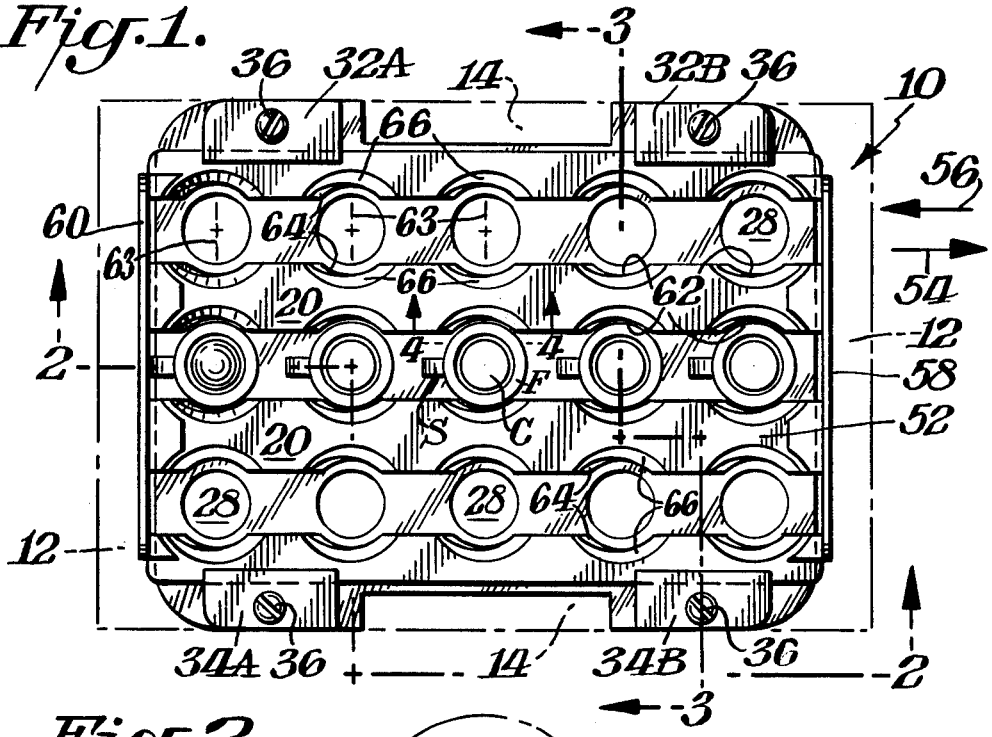

Throughout the following detailed description similar reference numerals refer to similar elements in all Figures of the drawings.

With reference to the Figures the microtube adapter in accordance with the present invention is generally indicated by reference character 10. The adapter 10 may be sized to be received within a centrifuge bucket 12 of standard design. The bucket 12 is provided with upstanding flanges 14 having closed slots 16 which engage trunion pins (not shown) disposed at the outward end of radially adjacent arms of a swinging bucket centrifuge rotor in a manner understandable by those skilled in the art.

Figure 1A:
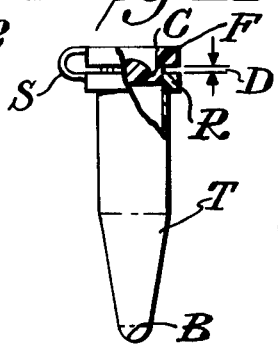
FIG. 1A is a definitional diagram showing a microtube in an elevational view with a portion broken away.

The containers with which the adapter 10 of the present invention is used are generally known as microtubes. As seen in FIG. 1A each microtube is an elongated tubular member T having a rounded bottom B and an enlarged shoulder or rim R surrounding the mouth of the tube T. The tube T is closable by a stopper or closure C having an annular flange F. The closure C is usually connected by a strap S to the tube T. Wth the closure C inserted into the mouth of the tube T to close the same a clearance distance D is defined between the upper surface of the rim R and the lower surface of the flange F on the closure C.

Figure 2:
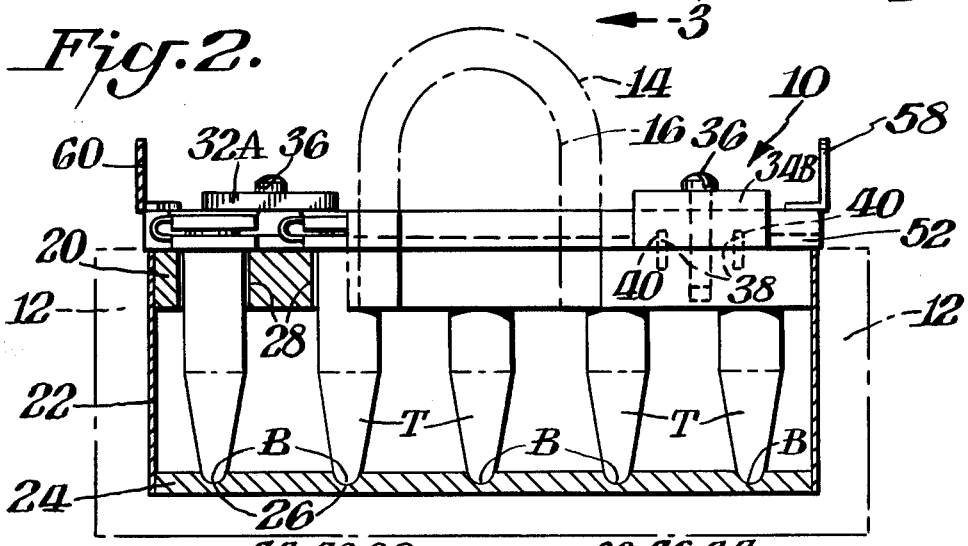
FIGS. 2, 3 and 4 are sectional views respectively taken along section lines 2—2, 3—3 and 4—4 in FIG. 1.

The adaptor 10 includes a support plate 20 sized to substantially cover the mouth of the bucket 12. A basket 22 (FIG. 2) depends from the support plate 20 into the bucket 12. The bucket 22 is closed by a floor 24 having rounded dimples 26 therein. The support plate 20 is provided with a plurality of openings 28 each sized to receive a microtube T. The openings 28 in the support plate 20 are sized to receive and support the tubes T with the undersurface of the rim R on the tube T shouldering against and supported by that portion of the support plate 20 surrounding and defining the openings 28 therein. The bottom B of each tube T is received in a rounded dimple 26 in the floor 24. Of course, the slide plate 20 may be provided with suitable support struts (with or without a floor portion) to enable the adapter 20 to be used as a benchtop accessory or to hold tubes in apparatus other than a centrifuge.

Figure 3:
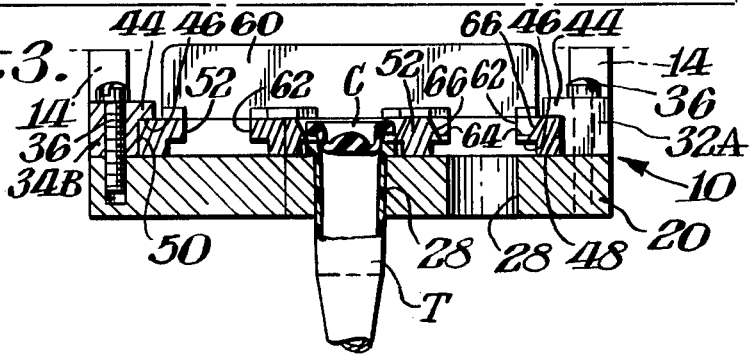

Each of the elongated sides of the support plate 20 is provided with a pair of track guides 32A, 32B and 34A, 34B respectively. Each track guide is secured to the plate 20 by screws 36. Location of the guides 32, 34 with respect to the plate 20 is further facilitated by positioning pins 38 received within registering bores 40 disposed in the guides and the plate 20. The track guides are undercut to define flanges 44. The undersurface 46 (FIG. 3) of the flanges on the guides cooperates with the upper surface of the support plate 20 above which it is disposed to define channels 48 and 50. The channels 48 and 50 extend along those edges of the support plate 20 that border the sides of the bucket 12 from which the flanges 14 project. If the adapter 12 takes a perimetric shape other than rectangular, the guides are disposed thereon in positions which will define channels adjacent to the portions of the bucket from which the flanges project. Accordingly, it should be appreciated that although the adapter 10 is shown in the Figures as rectangular it is contemplated that the adapter 10 may be configured into any shape (including square, rounded or oval) necessary to conform to the shape of the mouth of the bucket with which it is associated.

Figure 7:
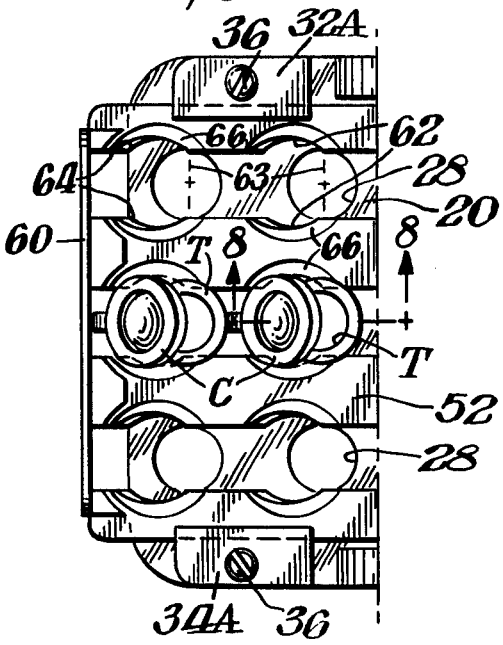
FIG. 7 is a partial plan vlew of the slide plate displaced with respect to the support plate from the home position in a second direction to the second, or uncapping, position; and, FIG. 8 is a section view taken along section lines 8—8 in FIG. 7.
Figure 8:
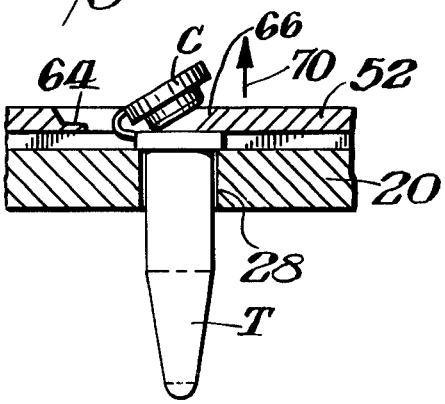

In accordance with this invention a substantially planar slide plate 52 corresponding in shape to the support plate 20 is mounted for sliding movement with respect thereto in the channels 48 and 50. The slide plate 52 is moveable in the channels 48, 50 with respect to the support plate 20 in generally reciprocal directions as indicated by the arrows 54 and 56. Displacing the slide plate 52 in the holding direction of the arrow 54 moves the slide plate 52 from the neutral, or home, position toward a first, or holding, position discussed in connection with FIGS. 5 and 6. Conversely, displacing the slide plate 52 in the uncapping direction of the arrow 56 moves the slide plate 52 toward a second, or uncapping position discussed in connection with FIGS. 7 and 8. Handles 58 and 60 are secured to the slide plate 52 to facilitate manipulation thereof.

The slide plate 52 has an array of apertures 62 corresponding in number to the openings 28 provided in the support plate 20. Each of the apertures 62 has a reference axis 63 extending through the opening. The references axis 63 are generally parallel to each other and lie perpendicular to the directions of motion 54, 56 of the slide plate 52.

Each of the apertures 62 has at least one overhang or retaining lip 64 disposed on the boundary thereof. The retaining lip 64 disposed on that portion of the plate 52 of the side of the reference axis 64 opposite the holding direction 54. Of course, a lip 64 may be disposed on each lateral side of each aperture 62, as shown in the Figures.

The slide plate 52 also has provided on the portion thereof adjacent each aperture 62 with at least one inclined cam surface 66. The cam surface 66 is disposed on the opposite side of the reference axis 64, i.e., on the side of the reference axis opposite to the uncapping direction 56. Each cam surface 66 increases in height from the boundary of the aperture 62 toward the upper surface of the slide plate 52. A cam surface 66 may be disposed on each lateral side of each aperture 62, as shown in the Figures.

In use, the slide plate 52 is initially disposed in the neutral, or home, position (FIGS. 1–4) with respect to the support plate 20 wherein the apertures 62 in the slide plate 20 are coaxially disposed above the openings 28 in the support plate 20. The diameter of the apertures 62 in the slide plate 52 are generally greater than the diameter of the rim R of the tube T so that with the slide plate 52 in the home position a tube T may be unobstructedly inserted into and received by the plate 20 such that the undersurface of the rim R of the tube T abuts against the upper surface of the support plate 20.

Figure 5:
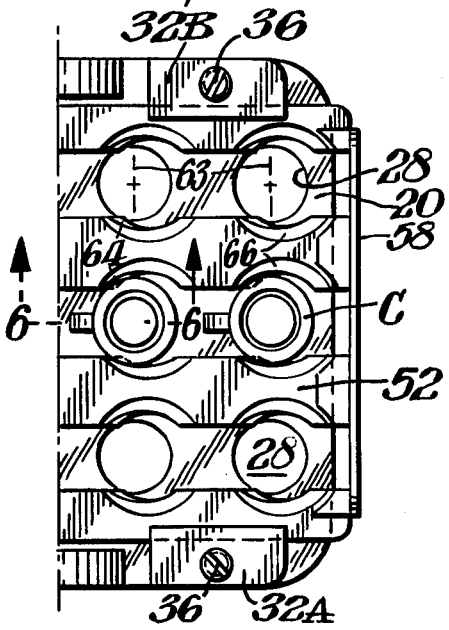
FIG. 5 is a partial plan view of the slide plate displaced with respect to the support plate fom the home position in a first direction to the first, or holding, position.
Figure 4:
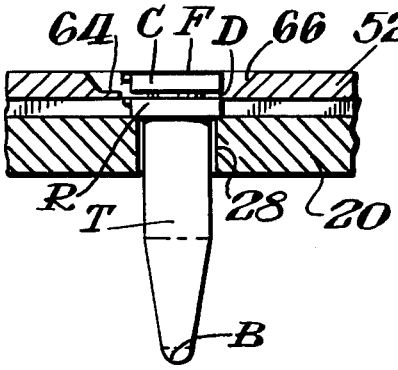
Figure 6:
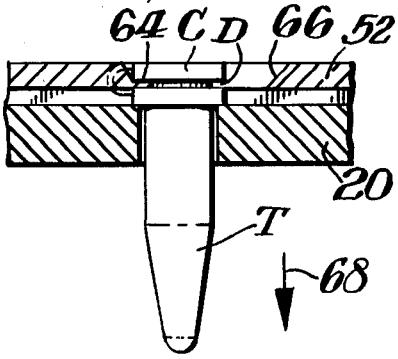
FIG. 6 is a section view taken along section lines 6—6 in FIG. 5.

To secure the tubes T on the support plate 20 the slide plate 52 is displaced (as by using the handle 58) with respect to the support plate 20 in the holding direction indicated by the arrow 54. This displacement in the direction of the arrow 54 moves each retaining lip 64 of the slide plate 52 to a position where it enters into the clearance space D between the rim R of the tube and the flange F of the closure C to thereby overlie some portion of the upper surface of the rim R on the body of the tube T. With the slide plate 52 so positioned (as shown in FIGS. 5 and 6) a holding force is imposed on each tube in the direction of an arrow 68 such that movement of the tube out of the associated opening 28 in the support plate 20 is prohibited.

Movement of the slide plate 52 in a direction 56 opposite to the direction 54 (as by using the handle 60) progressively introduces each cam surface 66 into the clearance space D. Continued movement of the slide plate 52 in the direction 56 causes the cam surface 66 to engage against the undersurface of the flange F on the closure C and generates an uncapping force acting in axially upwardly of the axis of the tube T in the direction of the arrow 70 to thereby remove the closure C from the tube T. If desired, to retain the uncapped tubes in place to permit, for example, the contents thereof to be poured or otherwise emptied, the slide plate 52 may be moved in the direction 54 to return to the holding position.

Those skilled in the art having benefit of the teachings as hereinabove set forth may effect numerous modifications thereof. These modifications are to be construed as lying within the scope of the present invention as defined in the appended claims.

What is claimed is:

1. An adapter for carrying a rimmed tube comprising:

a support plate having an opening therein, the opening being sized to receive and support a tube on the undersurface of the rim thereof; and a slide plate having a retaining lip thereon, the slide plate being mounted above the support plate and moveable with respect thereto from a home position in which a tube is insertable into the support plate without obstruction by the slide plate to a first, holding, position in which the retaining lip overlies a portion of the rim of a tube insertable into the support plate thereby to maintain the tube in the opening in the support plate.

2. The adapter of claim 1 wherein the rimmed tube has a closure which, when received in the tube, defines a clearance space between a flange on the closure and the upper surface of the rim on the tube, the slide plate further having a cam surface thereon, the slide plate being moveable with respect to the support plate toward a second, uncapping, position, movement of the slide plate toward the uncapping position progressively introducing the cam surface into the clearance space between the closure and the tube to separate the closure from the tube.

3. The adapter of claim 2 wherein the retaining lip and the cam surface are mounted on the slide plate in opposed relationship such that displacement of the slide plate in a first direction moves the slide plate to the first, holding, position and displacement of the slide plate in an opposing direction moves the slide plate to the second, uncapping, position.

4. An adapter for carrying a rimmed tube, the tube having a closure cap which when received in the tube defines a clearance space between a flange on the closure cap and the upper surface of the rim on the tube, the adapter comprising:

a support plate having an opening therein, the opening being sized to receive and support a tube on the undersurface of the rim thereof; and a slide plate having a cam surface thereon, the slide plate being moveable with respect to the support plate from a home position in which a tube is insertable without obstruction into the support plate toward an uncapping position, movement of the slide plate toward the uncapping position progressively introducing the cam surface into the clearance space between the closure and the tube to separate the closure cap from the tube.

5. The adapter of claim 4 wherein the slide plate further includes a retaining lip thereon, the slide plate being mounted above the support plate and moveable with respect thereto from the home position to a holding position in which the retaining lip overlies a portion of the rim of the tube to thereby maintain the tube in the opening in the support plate.

6. The adapter of claim 5 wherein the cam surface and the retaining lip are mounted on the slide plate in opposed relationship such that displacement of the slide plate in a first direction moves the slide plate to the holding position and displacement of the slide plate in an opposing direction moves the slide plate to the uncapping position.

7. An adapter for carrying a tube of the type having a rim about the mouth thereof and a closure cap which, when received in the tube, defines a clearance space between a flange on the closure and the upper surface of the rim on the tube, the adapter comprising:

a support plate having an opening therein, the opening being sized to receive and support a tube on the undersurface of the rim thereof;

a slide plate slidably disposed with respect to the support plate, the slide plate having an aperture therein, the aperture being sized such that when the slide plate is in a home position a tube may be unobstructedly insertable into the opening in the support plate, the aperture having a reference axis therethrough, one side of the aperture on one side of the reference axis having a retaining lip thereon, the slide plate being moveable from the home position in a first direction to dispose the retaining lip above the upper surface of the rim of the tube in the support plate; and a cam surface disposed about the aperture in the slide plate on the opposite side of the reference axis, movement of the slide plate in a second, opposite, uncapping direction introducing the cam surface into the clearance between the flange and the rim of the tube to thereby uncap the same.

* * * * *